US009597874B2

(12) United States Patent
Goto

(10) Patent No.: US 9,597,874 B2
(45) Date of Patent: Mar. 21, 2017

(54) LIQUID EJECTION HEAD, LIQUID EJECTING APPARATUS, AND METHOD FOR MANUFACTURING LIQUID EJECTION HEAD

(71) Applicant: CANON KABUSHIKI KAISHA, Tokyo (JP)

(72) Inventor: Akio Goto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/450,099

(22) Filed: Aug. 1, 2014

(65) Prior Publication Data

US 2015/0042712 A1 Feb. 12, 2015

(30) Foreign Application Priority Data

Aug. 7, 2013 (JP) ..... 2013-163850

(51) Int. Cl.

| | |
|---|---|
| ***B41J 29/38*** | (2006.01) |
| ***B41J 2/14*** | (2006.01) |
| ***B41J 2/16*** | (2006.01) |
| *B41J 2/015* | (2006.01) |

(52) U.S. Cl.

CPC ..... *B41J 2/1433* (2013.01); *B41J 2/14145* (2013.01); *B41J 2/162* (2013.01); *B41J 2/1603* (2013.01); *B41J 2/1628* (2013.01); *B41J 2/1631* (2013.01); *B41J 2/1639* (2013.01); *B41J 2/1642* (2013.01); *B41J 2/1645* (2013.01); *B41J 2/1646* (2013.01); *B41J 2002/14387* (2013.01); *B41J 2002/14411* (2013.01)

(58) Field of Classification Search

CPC ..... B41J 2/14; B41J 2/14016; B41J 2/1433; B41J 2002/14411

USPC ..... 347/12, 13, 20

See application file for complete search history.

(56) References Cited

U.S. PATENT DOCUMENTS

| | | | | |
|---|---|---|---|---|
| 4,422,082 | A * | 12/1983 | Louzil | B41J 2/162 29/527.4 |
| 5,381,166 | A * | 1/1995 | Lam et al. | 346/140.1 |
| 6,347,855 | B1 * | 2/2002 | Takanaka | 347/19 |
| 6,474,566 | B1 * | 11/2002 | Hirota et al. | 239/102.2 |
| 6,527,370 | B1 * | 3/2003 | Courian et al. | 347/47 |
| 6,938,988 | B2 * | 9/2005 | Clark et al. | 347/47 |
| 7,168,787 | B2 * | 1/2007 | Jung | B41J 2/1603 347/47 |

(Continued)

FOREIGN PATENT DOCUMENTS

JP 2009-137155 A 6/2009

*Primary Examiner* — Jannelle M Lebron
*Assistant Examiner* — Jeremy Bishop
(74) *Attorney, Agent, or Firm* — Canon U.S.A. Inc., IP Division

(57) ABSTRACT

A liquid ejection head includes a substrate and a flow path forming member. Energy generating elements that generate energy with which a liquid is ejected are formed on the substrate. The flow path forming member is disposed on the substrate and a flow path which encloses the energy generating elements is formed using the flow path forming member. Plural ejection ports that are in communication with the flow path are formed in the flow path forming member. A groove portion extending obliquely with respect to an X direction in which adjoining ejection ports are arranged is formed between the adjoining ejection ports in the flow path forming member.

10 Claims, 5 Drawing Sheets

(56) References Cited

U.S. PATENT DOCUMENTS

| | | | | |
|---|---|---|---|---|
| 7,207,648 | B2 * | 4/2007 | Kojima et al. | 347/22 |
| 7,669,966 | B2 * | 3/2010 | Shimura et al. | 347/47 |
| 8,033,645 | B2 * | 10/2011 | Van Den Berg et al. | 347/47 |
| 8,061,808 | B2 * | 11/2011 | Nagata | 347/47 |
| 8,061,815 | B2 * | 11/2011 | Silverbrook | 347/57 |
| 8,506,050 | B2 * | 8/2013 | Cringus et al. | 347/45 |
| 2004/0174411 | A1 * | 9/2004 | Sumiya et al. | 347/47 |
| 2006/0033783 | A1 * | 2/2006 | Bruinsma et al. | 347/65 |
| 2007/0236540 | A1 * | 10/2007 | Hollands B41J | 2/1433 347/68 |

* cited by examiner

LIQUID EJECTION HEAD, LIQUID EJECTING APPARATUS, AND METHOD FOR MANUFACTURING LIQUID EJECTION HEAD

BACKGROUND OF THE INVENTION

Field of the Invention

The present invention relates to a liquid ejection head that ejects a liquid, a liquid ejecting apparatus provided with the liquid ejection head, and a method for manufacturing the liquid ejection head.

Description of the Related Art

Liquid ejecting apparatuses, like ink jet recording apparatuses, have been proposed. A liquid ejecting apparatus is provided with a liquid ejection head that ejects a liquid, such as ink. Plural ejection ports are formed in the liquid ejection head, and the liquid is ejected from the ejection ports when energy emitted from an energy generating element is applied to the liquid.

The liquid ejection head disclosed in Japanese Patent Laid-Open No. 2009-137155 includes a substrate in which an energy generating element is provided, and a flow path forming member disposed on the substrate. Plural flow paths and ejection ports each in communication with each of the flow paths are formed using partition portions provided in the flow path forming member. The plural flow paths are disposed symmetrically about each of the ejection ports.

SUMMARY OF THE INVENTION

The present invention is a liquid ejection head which includes: a substrate on which energy generating elements that generate energy with which a liquid is ejected are provided; and a flow path forming member disposed on the substrate, the flow path forming member having a flow path that encloses the energy generating elements and plural ejection ports that are in communication with the flow path formed therein, wherein a groove portion extending obliquely with respect to a direction in which adjoining ejection ports are arranged is formed between the adjoining ejection ports at the flow path forming member.

Further features of the present invention will become apparent from the following description of exemplary embodiments with reference to the attached drawing.

DESCRIPTION OF THE EMBODIMENTS

Recently, an increase in ejection speed at the liquid ejection head has been required. As the ejection speed becomes higher, it has been required to increase refilling speed of the liquid. Exemplary means for increasing the refilling speed of the liquid may include reducing the number of the partition portions in the flow path forming member or reducing the size of the partition portions to increase the volume of the flow paths.

However, in the liquid ejection head disclosed in Japanese Patent Laid-Open No. 2009-137155, if the number of the partition portions in the flow path forming member is reduced or if the size of the partition portions is reduced, the plural ejection ports adjoin to each other without any partition portions disposed therebetween. If an impact is applied to the liquid ejection head and a crack is produced with one of the adjoining ejection ports as a starting point, since the adjoining ejection ports are not partitioned by the partition portions, the crack may reach the other of the adjoining ejection ports, whereby both of the adjoining ejection ports may be damaged.

Then, an object of the present invention is to reduce damage to the other of the adjoining ejection ports caused by the crack produced with one of the adjoining ejection ports as a starting point.

Hereinafter, embodiments of the present invention will be described with reference to the drawings.

Figure 1A:
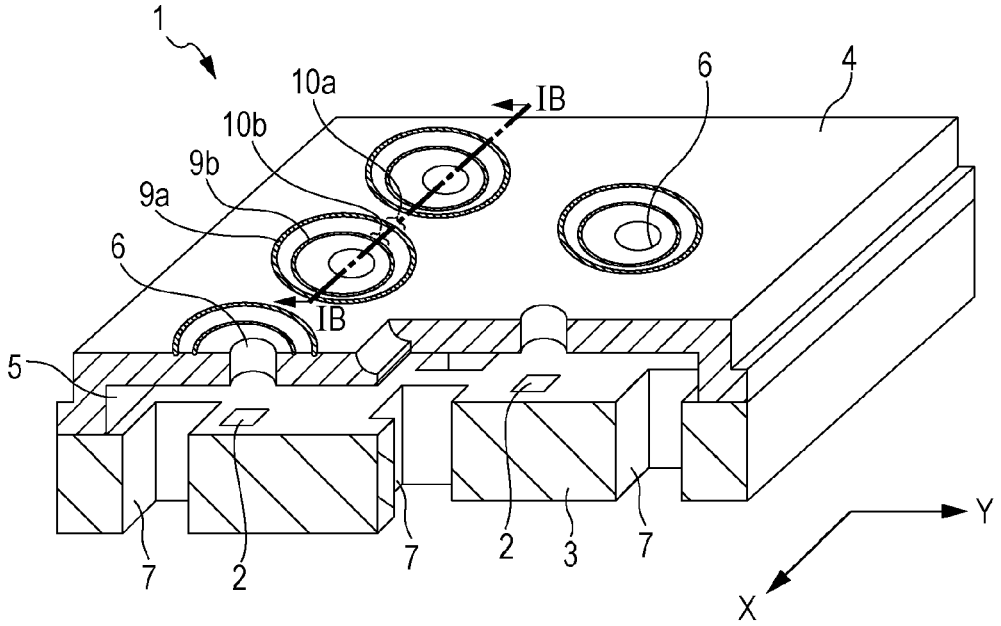
FIG. 1A is a partial cross-sectional perspective view and FIG. 1B is a cross-sectional view of a liquid ejection head according to the present invention.
Figure 1B:
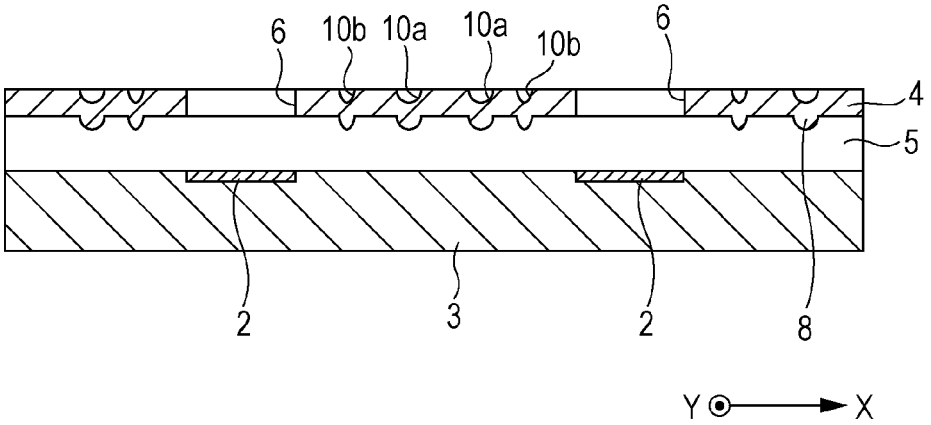

FIG. 1A is a partial cross-sectional perspective view illustrating an example of a liquid ejection head to which the present invention may be applied and FIG. 1B is a cross-sectional view of the liquid ejection head along line IB-IB of FIG. 1A. As illustrated in FIGS. 1A and 1B, a liquid ejection head 1 according to the present embodiment includes a substrate 3 and a flow path forming member 4. Energy generating elements 2 are provided on the substrate 3. The flow path forming member 4 is disposed on the substrate 3.

The substrate 3 is made, for example, of silicon. The energy generating elements 2 are, for example, heat transfer devices (i.e., heaters) including tantalum silicon nitride (TaSiN), or piezoelectric transducers. The energy generating elements 2 are provided on the substrate 3. However, it is not necessary that the energy generating elements 2 are in contact with the substrate 3. The energy generating elements 2 may not be in contact with the substrate 3 at least partially.

The flow path forming member 4 is made of a resin material, a metallic material or an inorganic material. Examples of the resin material may include photosensitive resin, such as epoxy resin. Examples of the flow path forming member 4 made of a metallic material may include a nickel plate. Examples of the inorganic material may include silicon nitride (SiN) and silicon carbide (SiC).

A flow path 5 which encloses the energy generating elements 2 is formed using the flow path forming member 4. Plural ejection ports 6 that are in communication with the flow path 5 are formed in the flow path forming member 4. The flow path 5 includes one liquid chamber that is in communication with one ejection port 6 or includes one large liquid chamber that is in communication with plural ejection ports 6.

A plate-shaped portion of the flow path forming member 4 at which the ejection ports 6 are formed is also called an orifice plate. An upper surface of the orifice plate is formed as an ejection port surface (i.e., a face surface). The ejection port surface is formed as the outermost surface of the flow path forming member 4, and the ejection ports 6 open on the ejection port surface.

The substrate 3 includes supply ports 7 that is in communication with the flow path 5. The supply ports 7 are formed, for example, by dry etching, such as reactive ion etching, and wet etching using, for example, hydroxylation tetramethylammonium (TMAH), applied to the substrate 3. A liquid is supplied to the flow path 5 from the supply ports 7 and is ejected from the ejection ports 6 when energy is applied by the energy generating elements 2.

The flow path forming member 4 includes bent portions 8. In FIG. 1B, plural bent portions 8 are provided and are bent to project toward the flow path 5. Each recess formed by each of the bent portions 8 on the front surface (i.e., the ejection port surface) of the flow path forming member 4 extends along a periphery of each ejection port 6 and forms the surround groove 9*a* and the surround groove 9*b* that surround each of the ejection ports 6.

In the present embodiment, the surround groove 9*b* is disposed inside the surround groove 9*a*. Although the surround grooves 9*a* and 9*b* are circular in shape, the shape of the surround grooves 9*a* and 9*b* is not limited to the same. For example, the surround grooves 9*a* and 9*b* may be elliptical or polygonal (for example, rectangular or triangular) in shape.

A groove portion of the surround groove 9*a* that is located between adjoining ejection ports 6 (hereafter, such a groove portion will be referred to as an "intermediate groove portion 10*a*") extends obliquely with respect to a first direction in which the adjoining ejection ports 6 are arranged (hereafter, the first direction will be referred also as an "X direction").

If the intermediate groove portion 10*a* extends in a curved manner as in the present embodiment, it is only necessary that a tangent of the intermediate groove portion 10*a* on an imaginary line connecting adjoining ejection ports 6 inclines with respect to the X direction. In a case in which the intermediate groove portion 10*a* is bent, at a bent position of the intermediate groove portion 10*a* located on the imaginary line connecting adjoining ejection ports 6, it is only necessary that the groove portion of the intermediate groove portion 10*a* extending linearly from the bent portion is inclined with respect to the X direction.

Stress concentrates further on a bottom portion of the groove than on a flat portion around the groove irrespective of the shape and size of a cross section of the groove (a cross section taken along a line crossing a direction in which the groove extends. The same shall apply hereafter). Since the crack runs along a portion at which stress concentrates, the crack that has reached the groove from the flat portion around the groove runs along the direction in which the groove extends except for a case in which the direction in which the groove extends and the direction in which the crack runs cross perpendicularly. That is, by providing the grooves, the direction in which the crack runs may be controlled.

In the liquid ejection head 1, stress is concentrated also on openings, such as ejection ports 6. Therefore, if an impact is applied to the liquid ejection head 1, a crack may be produced in the flow path forming member 4 with the ejection port 6 as a starting point.

In a case in which the orifice plate has a flat shape, the crack runs linearly. Therefore, in such an orifice plate, if a crack is produced with one of the adjoining ejection ports 6 as a starting point and directed to the other of the adjoining ejection ports 6, such a crack easily reaches the other of the adjoining ejection ports 6. As a result, a possibility that both of the adjoining ejection ports 6 are damaged becomes high.

In the present embodiment, the intermediate groove portion 10*a* extends obliquely with respect to the X direction. Therefore, a crack directed from one of the adjoining ejection ports 6 to the other of the adjoining ejection ports 6 begins running along a direction in which the intermediate groove portion 10*a* extends when the crack reaches the intermediate groove portion 10*a*. As a result, the crack does not reach the other of the adjoining ejection ports 6, whereby damage to the other of the adjoining ejection ports 6 otherwise caused by the crack produced at one of the adjoining ejection ports 6 is reduced.

It is not necessary that the groove is not bent to project toward the flow path 5 like the bent portion 8. For example, a recess may be formed on an ejection port surface and a surface of the flow path forming member on the side of the flow path 5 may be flat. Alternatively, a recess may not be formed on the ejection port surface and a recess or a projection may be formed on the surface of the flow path forming member on the side of the flow path 5. However, if a thickness of the flow path forming member is as uniform as possible, production of a crack with a portion of the flow path forming member having smaller thickness as a starting point may be reduced. From this point, the bent portion as illustrated in FIG. 1B, i.e., the bent portion which has a recess on the ejection port surface side and a projection on the flow path 5 side is desirable. The bent portion may have a projection on the ejection port surface side, but it is necessary to consider the contact between the projection and a recording medium and the like. For this reason, it is desirable that the recess is formed on the ejection port surface side or the ejection port surface is made flat.

In a flow path forming member 4 made of an inorganic material, a crack is more likely to be produced due to an impact applied to the flow path forming member 4 than in a flow path forming member 4 made of a resin material or a metallic material. Therefore, it is more desirable that the present invention is applied to a liquid ejection head 1 of which flow path forming member 4 is made of an inorganic material.

In a case in which a cross section of the intermediate groove portion 10*a* is a half-elliptical shape, a degree of concentration of the stress to the intermediate groove portion 10*a* with respect to the flat portion around the intermediate groove portion 10*a* is proportional to a depth of the intermediate groove portion 10*a* and inversely proportional to a width (i.e., a distance between side walls of the intermediate groove portion 10*a*. The same shall apply hereafter) of the intermediate groove portion 10*a*. Even if the cross section of the intermediate groove portion 10*a* is not elliptical in shape, if the cross section is substantially elliptical in shape, the degree of concentration of the stress to the intermediate groove portion 10*a* may be substantially proportional to the depth of the intermediate groove portion 10*a* and substantially inversely proportional to the width of the intermediate groove portion 10*a*.

The intermediate groove portion 10*a* may change the direction in which the crack runs irrespective of the depth and width of the intermediate groove portion 10*a*; however, the deeper the intermediate groove portion 10*a* with respect to the width of the intermediate groove portion 10*a*, expectations about the improvement in capability of changing the direction in which the crack runs becomes higher. From this reason, it is desirable that the width of the intermediate groove portion 10*a* is narrow as much as possible and the depth of the intermediate groove portion 10*a* is deep as much as possible.

A portion of the flow path forming member 4 at which the intermediate groove portion 10*a* is disposed is bent to project on the side of the flow path 5. Therefore, a thickness of the orifice plate at the portion at which the intermediate groove portion 10*a* is disposed and a thickness of the orifice plate at the portion at which the intermediate groove portion

10*a* is not disposed may be made the same. As a result, a decrease in strength of the orifice plate at the portion at which the intermediate groove portion 10*a* is disposed may be reduced.

Further, since the intermediate groove portion 10*a* is formed as a part of the surround groove 9*a*, the crack which has been changed its direction at the intermediate groove portion 10*a* runs around the ejection port 6 along the surround groove 9*a*. Therefore, it is possible to control the range in which the crack develops.

Although the surround groove 9*a* illustrated in FIG. 1A is formed as a continuous groove, the surround groove 9*a* may be formed as discontinuous groove portions that are arranged in the present invention.

In a case in which the surround groove 9*a* is formed as discontinuous groove portions that are arranged, If a non-groove portion between the discontinuous groove portions is located between adjoining ejection ports 6, a crack produced with one of the adjoining ejection ports 6 as a starting point and directed to the other of the adjoining ejection ports 6 runs through the non-groove portion and reaches the other of the ejection ports 6. From this reason, the discontinuous groove portions are arranged so that the non-groove portion is not located between adjoining ejection ports 6. The discontinuous groove portions disposed between adjoining ejection ports 6 becomes the intermediate groove portions 10*a*.

The surround groove 9*a* illustrated in FIG. 1A is symmetrical about a certain imaginary point located inside the surround groove 9*a*. However, in the present invention, it is not necessary that the surround groove 9*a* is symmetrical about a certain imaginary point located inside the surround groove 9*a*.

It is desirable that the surround groove 9*b*, among the surround grooves 9*a* and 9*b*, located at the innermost position is symmetrical in shape to the center of the ejection port 6 so that the liquid adhering to a surface of the flow path forming member 4 does not affect an ejecting operation of the liquid ejection head 1 as much as possible.

It is more desirable that one ejection port 6 is surrounded multiple times by the surround grooves 9*a* and 9*b*. By surrounding one ejection port 6 multiple times by the surround grooves 9*a* and 9*b*, stress is distributed to the plural surround grooves 9*a* and 9*b* and development of the crack with the ejection port 6 as a starting point is easily reduced.

In a case in which one ejection port 6 is surrounded multiple times by the surround grooves 9*a* and 9*b*, it is more desirable that the plural surround grooves 9*a* and 9*b* are not in similar positions. In a case in which the plural surround grooves 9*a* and 9*b* are in similar positions, if the crack is produced from the center of similarity, angles made by the crack and the plural surround grooves 9*a* and 9*b* become equal to each other, whereby development of the crack is not easily reduced. If the plural surround grooves 9*a* and 9*b* are not in similar positions, even if a crack is produced at the center of similarity, the angles made by the crack and the plural surround grooves 9*a* and 9*b* do not become equal to each other. For this reason, even if the direction in which the crack runs is not changed by the relationship of the angle made by the crack and the surround groove 9*b*, the direction of running is changed at the surround groove 9*a* and development of the crack with the ejection port 6 as a starting point is easily reduced.

Even if the change in the direction in which the crack runs in the surround groove 9*b* is not enough, the direction in which the crack runs may be changed using the surround groove 9*a*. As a result, a crack produced with one of the adjoining ejection ports 6 as a starting point less easily reaches the other of the adjoining ejection ports 6, whereby damage to the other of the adjoining ejection ports 6 otherwise caused by the crack produced at one of the adjoining ejection ports 6 is further reduced.

In the present embodiment, the surround groove 9*a* is circular in shape, and the center of the circular shape is disposed further toward a second direction (hereafter, the second direction is referred also to as a "Y direction") than the center of the ejection port 6 that crosses the X direction. With this configuration, a direction in which the intermediate groove portion 10*a* of the surround groove 9*a* extends is inclined with respect to the X direction.

The surround groove 9*b* is circular in shape and the center of the circular shape is located at the center of the ejection port 6. Therefore, a groove portion of the surround groove 9*b* located between adjoining ejection ports 6 (hereafter, the groove portion will be referred to as an "intermediate groove portion 10*b*") extends perpendicularly to the X direction. For this reason, a crack produced with the ejection port 6 as a starting point and running in the X direction continuously runs in the X direction even after reaching the intermediate groove portion 10*b*.

Since the intermediate groove portion 10*a* is inclined with respect to the X direction, the crack which has run through the intermediate groove portion 10*b* begins running along a direction in which the intermediate groove portion 10*a* extends when the crack reaches the intermediate groove portion 10*a*. As a result, a crack produced at one of the adjoining ejection ports 6 less easily reaches the other of the adjoining ejection ports 6 and damage to the other of the adjoining ejection ports 6 is reduced.

The number of the surround grooves that surround one ejection port 6 is not limited to two; three or more surround grooves may be formed. In a case in which three or more surround grooves which are circular in shape surround one ejection port 6, it is only necessary that the center of at least one surround groove is disposed further toward the Y direction than the center of the ejection port 6.

It is not necessary that the surround grooves 9*a* and 9*b* are similar in shape and, for example, the surround groove 9*a* may be rectangular and the surround groove 9*b* may be triangular in shape. It is only necessary that at least one of the intermediate groove portions 10*a* and 10*b* extends obliquely with respect to the X direction.

In a case in which the surround grooves 9*a* and 9*b* are formed as discontinuous groove portions that are arranged, it is desirable that first non-groove portions between discontinuous groove portions which form the surround groove 9*a* and second non-groove portions between discontinuous groove portions which form the surround groove 9*b* are arranged in a staggered pattern or in an alternate pattern. By arranging the first and second non-groove portions in a staggered pattern or in an alternate pattern, a crack produced inside the surround grooves 9*a* and 9*b* less likely runs outside the surround grooves 9*a* and 9*b*.

Although a part of the surround groove 9*a* is formed as the intermediate groove portion 10*a* obliquely extending with respect to the X direction in the present embodiment, the intermediate groove portion 10*a* is not necessarily a part of the surround groove 9*a*. For example, the intermediate groove portion 10*a* may be a part of a groove that extends spirally about the ejection port 6. The intermediate groove portion 10*a* may be a groove that linearly extends between adjoining ejection ports 6 obliquely with respect to the X direction.

It is more desirable that the liquid ejection head 1 is mounted on a liquid ejecting apparatus provided with a control unit that executes a defective ejection complement operation. The "defective ejection complement operation" is, in a state in which only one of adjoining ejection ports is damaged, an operation to complement defective ejection of the one of the ejection ports by ejecting a liquid from the other of the ejection ports instead of the one of the ejection ports. In a liquid ejection head in which the other of the ejection ports is easily damaged due to the crack produced at one of the adjoining ejection ports, a state in which both of the adjoining ejection ports are damaged is easily created. In this state, it is difficult to perform the defective ejection complement operation. For this reason, the liquid is not ejected to desired positions, and performance of the liquid ejection head is lowered.

In the liquid ejection head according to the present invention, damage to the other of the adjoining ejection ports caused by the crack produced at one of the adjoining ejection ports is reduced. Therefore, a state in which both of the adjoining ejection ports are damaged is less easily created. For this reason, when the defective ejection complement operation is performed, the liquid is ejected to a desired position and a decrease in performance of the liquid ejection head is reduced. The adjoining ejection ports are not limited to a certain ejection port and the ejection port closest to that certain ejection port; the adjoining ejection ports refer to a certain ejection port and either front or rear ejection port of the certain ejection port in a direction in which arbitrary ejection ports are arranged (i.e., an arrangement direction).

In a case in which the liquid ejection head 1 is mounted on and used in an ink jet recording apparatus, an impact may be applied to the flow path forming member 4 due to contact between a recording medium, such as a print sheet, and the liquid ejection head 1, whereby a crack is easily produced in the flow path forming member 4. From this reason, it is more desirable to apply the present invention to a liquid ejection head mounted on an ink jet recording apparatus.

Subsequently, a method for manufacturing the liquid ejection head 1 will be described with reference to FIGS. 2A to 2E. FIGS. 2A to 2E are diagrams illustrating the method for manufacturing the liquid ejection head 1. In FIGS. 2A to 2E, each process of the method for manufacturing is drawn as cross-sectional views taken along line IB-IB of FIG. 1A.

Figure 2A:
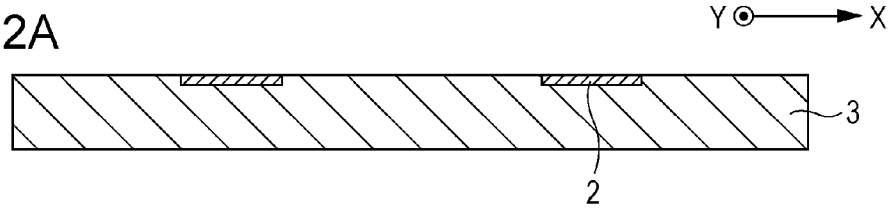
FIGS. 2A to 2E are diagrams illustrating a method for manufacturing the liquid ejection head according to the present invention.

First, as illustrated in FIG. 2A, the substrate 3 on which the energy generating elements 2 are provided is prepared. The substrate 3 is desirably made of silicon single crystal. By using the substrate 3 made of silicon single crystal, a driving circuit that drives the energy generating elements 2 may be formed on the substrate 3 relatively easily. The energy generating elements 2 are formed, for example, by heat transfer devices (i.e., heaters), such as TaSiN, or piezoelectric transducers.

Figure 2B:
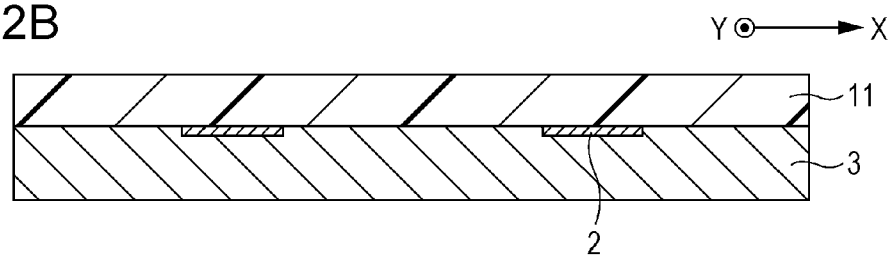

Next, as illustrated in FIG. 2B, the mold material 11 for forming a liquid chamber or the flow path 5 (see FIGS. 1A and 1B) is formed in the substrate 3 on the side on which the energy generating elements 2 are provided.

A material of the mold material 11 is determined in consideration of removability from a material of the peripheral member of the flow path 5. In a case in which an inorganic material is used for the flow path forming member 4 (see FIGS. 1A and 1B), it is desirable that the mold material 11 is made of a resin material or a metallic material.

As the resin material used for the formation of the mold material 11, polyimide is desirable in consideration of heat resistance during subsequent processes, especially a process of forming the flow path forming member 4.

In order to form the mold material 11 made of a resin material, a resin layer is first formed on the substrate 3 using, for example, a spinning coat method. In a case in which photosensitive resin is used as the resin material, the mold material 11 is formed by patterning the resin layer using photolithography. In a case in which nonphotosensitive resin is used as the resin material, a mask for forming the mold material (not illustrated) is formed by, for example, photosensitive resin on the resin layer. Then, the resin layer is etched using gaseous chlorine and patterned to form the mold material 11.

As the metallic material used for the formation of the mold material 11, aluminum or aluminum alloy is desirable in consideration of removability of the mold material 11.

In order to form the mold material 11 made of a metallic material, metal film is first formed on the substrate 3 using physical vapor deposition method (PVD), such as sputtering. Then, a mask for forming the mold material (not illustrated) is formed on the metal film.

The mold material 11 is formed on the substrate 3 by performing reactive ion etching (RIE) to the metal film using gas suitable for the metal film. If the metallic material is aluminum, it is desirable to use gaseous chlorine as etching gas.

Figure 2C:
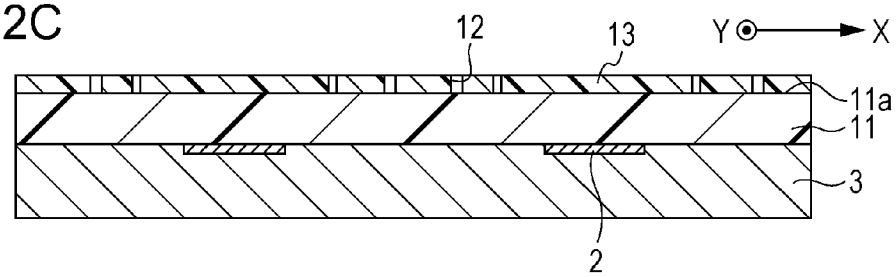

After the mold material 11 is formed on the substrate 3, as illustrated in FIG. 2C, a mask 13 including the elongated hole 12 (referred also to as a "mask for forming the recessed portion") is formed on a surface 11*a* on the side opposite to the substrate 3. The mask 13 is formed by patterning, using photolithography, the elongated hole 12 on the photosensitive resin applied to the mold material 11. The elongated hole 12 extends in a predetermined direction inclined with respect to the X direction.

Figure 2D:
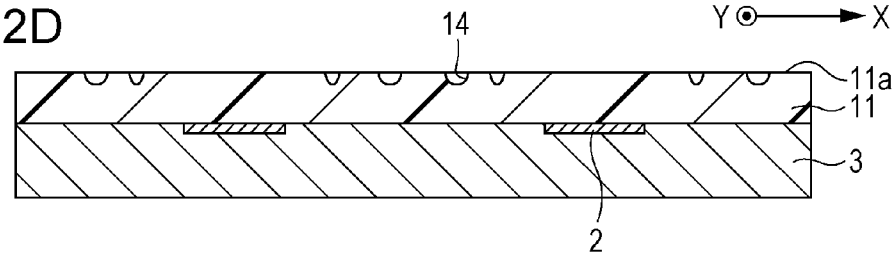

Subsequently, as illustrated in FIG. 2D, the mold material 11 is etched via the mask 13 and then the mask 13 is removed. By etching the mold material 11, a recessed portion 14 is formed at a position corresponding to the elongated hole 12 of the mask 13. Since the longitudinal direction of the elongated hole 12 is inclined with respect to the X direction, the recessed portion 14 extends along the longitudinal direction of the elongated hole 12, i.e., a direction inclined with respect to the X direction.

In a case in which the mold material 11 is made of a metallic material, wet etching and isotropic dry etching are used. In a case in which the mold material 11 is made of a resin material, etching is performed using oxygen gas.

Although the recessed portion 14 is formed by etching the mold material 11, that is, by removing a part of the mold material 11 in the example illustrated in FIGS. 2A to 2E, the recessed portion 14 may be formed by any other methods. For example, plural projections may be formed in a plate-shaped mold material 11 and portions between adjoining projections may be defined as the recessed portion 14. Both the recessed portion 14 and a projection may be formed in the mold material 11.

Figure 2E:
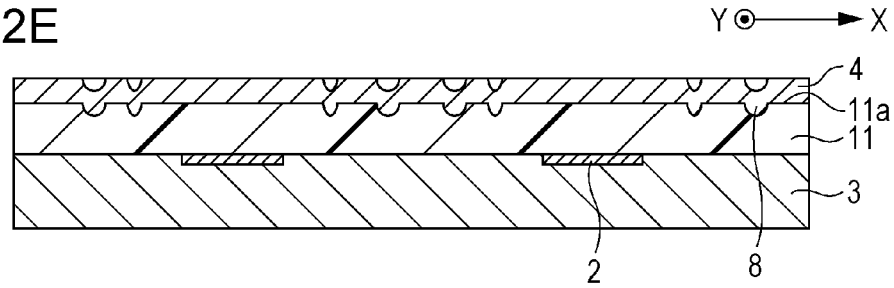

After the recessed portion 14 is formed in the mold material 11, as illustrated in FIG. 2E, film made of an inorganic material is formed on the surface 11*a* by the chemical vapor deposition (CVD) method. By forming the film that covers the substrate 3 and the mold material 11, the film becomes the flow path forming member 4 including the orifice plate.

As the inorganic material used for flow path forming member 4, a material with relatively high resistance to the liquid to be ejected and with relatively high machinery strength is desirable. For example, a compound of silicon and either of oxygen, nitrogen and carbon is desirable. In particular, silicon nitride (SiN), silicon oxide (SiO2), silicon carbide (SiC) and the like are used.

When heat resistance of the mold material 11 is considered, it is desirable that a method for forming the film of the inorganic material that becomes the flow path forming member 4 is the plasma enhanced CVD (PECVD) method in which a film deposition temperature can be relatively low. The method for film deposition is not limited to the CVD method as long as film of an inorganic material is deposited conformally. In a case in which the flow path forming member 4 is made of a metallic material, plating may be used as the method for film deposition.

Since the film of the inorganic material is formed conformally, the recessed portion 14 of the mold material 11 is transferred to the film of the inorganic material and depression and projection are formed in the film of the inorganic material. As a result, the bent portion 8 is formed in the orifice plate of the flow path forming member 4. Although the cross section of the bent portion 8 is substantially semicircular in the example illustrated in FIG. 2E, the cross sectional shape of the bent portion 8 may be substantially semielliptical or may be wedge-shaped.

Since the recessed portion 14 extends in the direction inclined with respect to the X direction, the recess formed on the front side of the flow path forming member 4 of the bent portion 8 extends in the direction inclined with respect to the X direction.

After the flow path forming member 4 is formed, plural ejection ports 6 (see FIGS. 1A and 1B) are formed in the flow path forming member 4. The plural ejection ports 6 are arranged in the X direction with the bent portion 8 being disposed therebetween. As a result, the recess formed on the front side of the flow path forming member 4 by the bent portion 8 becomes the intermediate groove portion 10*a* (see FIG. 1A) disposed between adjoining ejection ports 6.

The plural ejection ports 6 are formed by, for example, etching the flow path forming member 4.

In particular, first, photosensitive resin is applied to the flow path forming member 4 and the mask is formed using photolithography. Subsequently, dry etching is performed to the flow path forming member 4 via the mask. As a result, a part of the flow path forming member 4 is removed and the ejection ports 6 are formed in the orifice plate.

After the ejection ports 6 are formed, the mold material 11 is removed and the flow path 5 (see FIGS. 1A and 1B) is formed. Then, the supply ports 7 (see FIGS. 1A and 1B) are formed in the substrate 3 and the liquid ejection head 1 is completed.

In a case in which the mold material 11 is made of a metallic material, the mold material 11 may be removed by reactive ion etching using gas suitable for the metallic material, or wet etching using a medical fluid suitable for the metallic material. In a case in which the mold material 11 is made of a resin material, the mold material 11 may be removed by etching using oxygen gas.

According to the manufacturing method described above, since the recessed portion 14 formed in the mold material 11 is transferred to the flow path forming member 4, the thickness of a portion of the flow path forming member 4 which becomes the bent portion 8 is the same as the thickness of the portion around the bent portion 8. As a result, the flow path forming member 4 with less variation in thickness of the orifice plate may be formed relatively easily.

Especially in a method in which a plate-shaped flow path forming member is cut to form the intermediate groove portion 10*a*, there is a possibility that the flow path forming member may be broken. According to this manufacturing method, since the intermediate groove portion 10*a* is formed using the bent portion 8 corresponding to the shape of the recessed portion 14, the flow path forming member 4 is less easily broken when the intermediate groove portion 10*a* is formed.

Since the intermediate groove portion 10*a* obliquely extending with respect to the X direction is formed between adjoining ejection ports 6, even if a crack is produced with one of the adjoining ejection ports 6 as a starting point, the crack less easily reaches the other of the adjoining ejection ports 6. As a result, damage to the other of the adjoining ejection ports caused by the crack produced at one of the plural ejection ports is reduced.

Hereinafter, the present invention will be described in more detail using examples.

First Example

Figure 3:
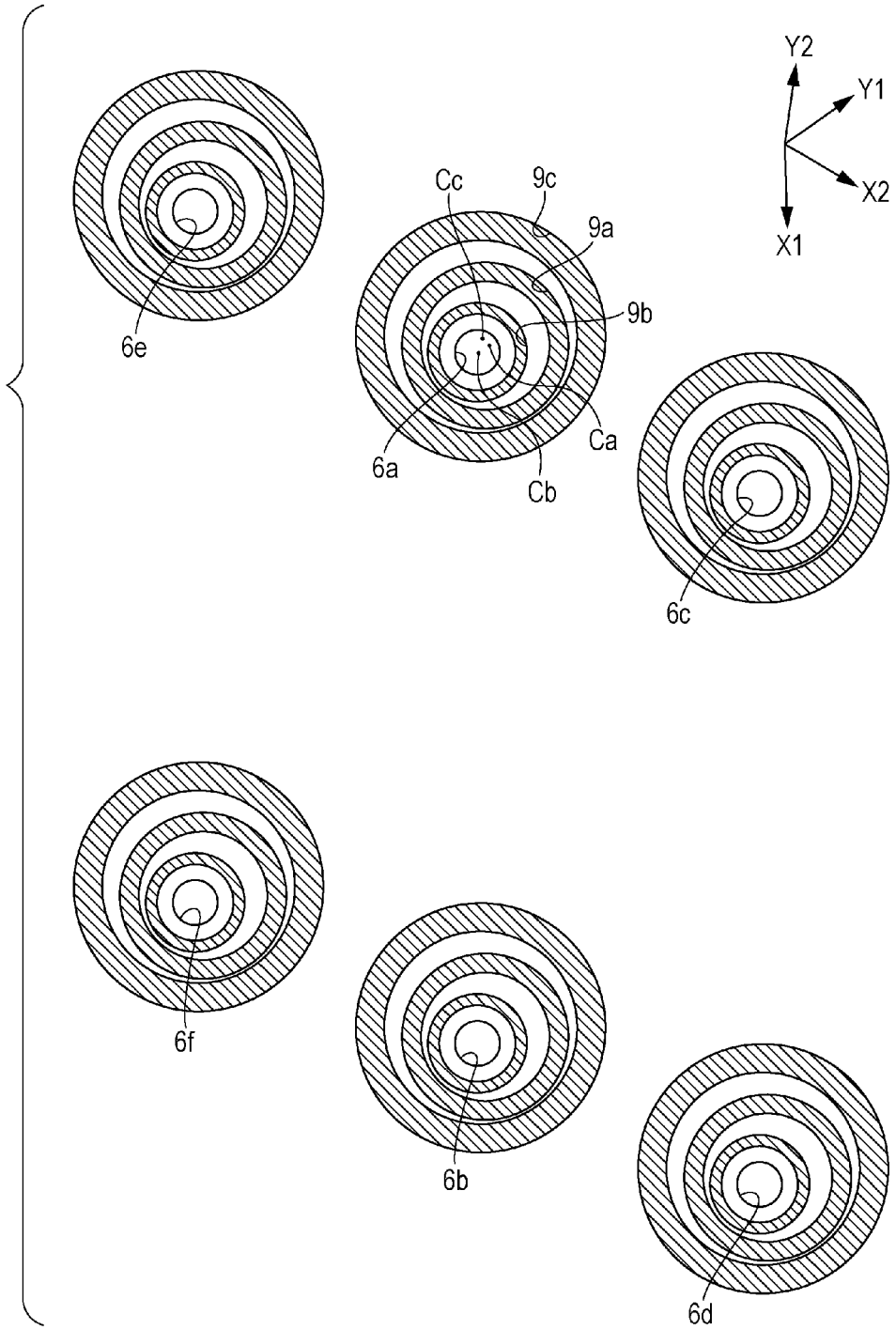
FIG. 3 is an enlarged plan view of a liquid ejection head according to a first example.

FIG. 3 is an enlarged plan view of the liquid ejection head 1 according to a first example of the present invention. In the example illustrated in FIG. 3, six ejection ports 6*a*, 6*b*, 6*c*, 6*d*, 6*e* and 6*f* are formed. Let a direction in which the ejection ports 6*a* and 6*b* are arranged be an X1 direction and let a direction in which the ejection ports 6*a*, 6*c* and 6*e* be an X2 direction.

The ejection port 6*a* is surrounded multiple times by substantially circular-shaped surround grooves 9*a*, 9*b* and 9*c*.

The center Cb of the surround groove 9*b* is located at the center of the ejection port 6*a*. Therefore, an intermediate groove portion of the surround groove 9*b* located between the ejection ports 6*a* and 6*b* which adjoin each other about the X1 direction extends perpendicularly to the X1 direction. For this reason, a crack produced with the ejection port 6*a* as a starting point and running in the X1 direction continuously runs in the X1 direction even after reaching the surround groove 9*b*.

The center Ca of the surround groove 9*a* is disposed further toward the Y1 direction that crosses the X1 direction than the center of the ejection port 6. Therefore, an intermediate groove portion of the surround groove 9*a* located between the ejection ports 6*a* and 6*b* which adjoin each other about the X1 direction extends obliquely with respect to the X1 direction. For this reason, a crack produced with the ejection port 6*a* as a starting point and running in the X1 direction runs the surround groove 9*a* at a position where it reaches the surround groove 9*a*.

The Y1 direction also crosses the X2 direction. Therefore, an intermediate groove portion of the surround groove 9*a* located between the ejection ports 6*a* and 6*c* which adjoin each other about the X2 direction extends obliquely with respect to the X2 direction. For this reason, a crack produced with the ejection port 6*a* as a starting point and running in the X2 direction runs the surround groove 9*a* at a position where it reaches the surround groove 9*a*.

As described above, in the liquid ejection head according to the present example, the crack produced with the ejection port 6*a* as a starting point does not reach other ejection ports 6*b*, 6*c*, 6*d*, 6*e* and 6*f*. Therefore, damage to the other of the adjoining ejection ports 6 caused by the crack produced at one of the adjoining ejection ports 6 is reduced.

The center Cc of a surround groove 9*c* is disposed further toward the Y2 direction that crosses the Y1 direction (referred also to a "third direction") than the center of the ejection port 6. Therefore, a portion of the surround groove 9*c* located from the center of the ejection port 6*a* toward the Y1 direction extends obliquely with respect to the Y1 direction. For this reason, a crack produced with the ejection port 6*a* as a starting point and running in the Y1 direction runs through the surround grooves 9*b* and 9*a*, but it runs along the surround groove 9*c* at a position where it reaches the surround groove 9*c*.

As described above, in the liquid ejection head according to the present example, since the centers Ca and Cc of the surround grooves 9*a* and 9*c* are distant from the center of the ejection port 6*a* in the Y1 direction and in the Y2 direction, respectively, development of the crack produced at the ejection port 6*a* is reduced. It is only necessary that the centers of at least two of the surround grooves 9*a*, 9*b* and 9*c* are distant from the center of the ejection port 6*a* in two different directions.

Figure 4:
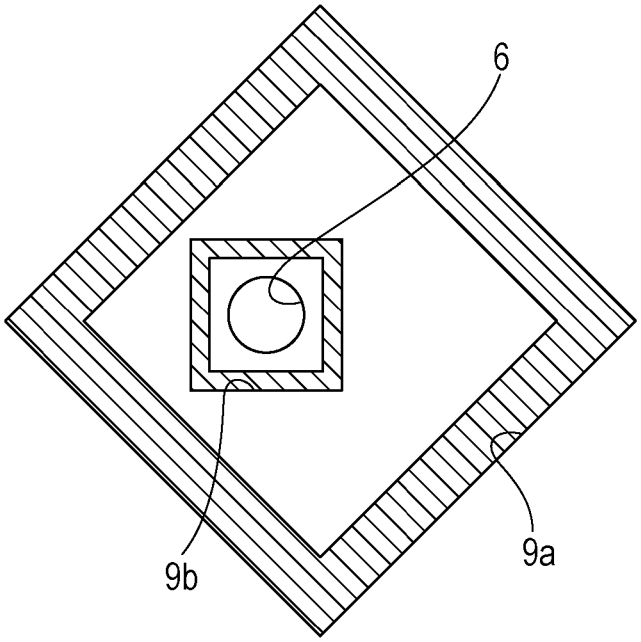
FIG. 4 is an enlarged plan view of a liquid ejection head modified from that of the first example.

In the example illustrated in FIG. 3, the three surround grooves 9*a*, 9*b* and 9*c* have circular shapes. However, two surround grooves 9*a* and 9*b* which have polygonal shapes as illustrated in FIG. 4 may be provided.

In a case in which the ejection port 6 is surrounded by two surround grooves 9*a* and 9*b* which have polygonal shapes, it is only necessary that a first linear groove portion included in the surround groove 9*a* extends obliquely with respect to a second linear groove portion included in the surround groove 9*b* and located next to the first linear groove portion. Here, "the second linear groove portion included in the surround groove 9*b* and located next to the first linear groove portion" means, for example, a linear groove portion of the surround groove 9*b* located between the first linear groove portion included in the surround groove 9*a* and the ejection port 6.

Subsequently, a method for manufacturing the liquid ejection head 1 according to the first example will be described in detail.

First, a substrate 3 on which the energy generating elements 2 are provided is prepared (see FIG. 2A). As the substrate 3, a silicon substrate of which surface crystal orientation is <100> is used. The energy generating elements 2 are made by TaSiN. SiN film (not illustrated) is formed as insulating film on the energy generating elements 2. Ta film (not illustrated) is formed as an anticavitation layer on the SiN film. Al wiring and electrode pads (not illustrated) which are electrically connected to the energy generating elements 2 are formed on the substrate 3.

Next, a mold material 11 used as a mold of a flow path corresponding to each energy generating element 2 is formed on the substrate 3 (see FIG. 2B).

Here, a method for forming the mold material 11 will be described in detail. First, 14 μm-thick polyimide film is formed on the substrate 3 by a spin coating method and a mask for forming the mold material made of photosensitive resin (not illustrated) is formed on the polyimide film. Next, using the mask for forming the mold material, the mold material 11 is formed by ashing the polyimide film using oxygen gas. Then, the mask for forming the mold material made of photosensitive resin is removed.

After the mold material 11 is formed, a mask 13 for forming a recessed portion including an elongated hole 12 is formed on the mold material 11 (see FIG. 2C). In particular, photosensitive resin is applied to the mold material 11, and the mask 13 for forming the recessed portion is formed by patterning, using photolithography, the elongated hole 12 of which longitudinal direction is inclined with respect to the X direction.

Next, the recessed portion 14 is formed in the mold material 11 by ashing the mold material 11 via the mask 13 for forming the recessed portion, and then the mask 13 for forming the recessed portion is removed (see FIG. 2D). A depth of the recessed portion 14 of the mold material 11 is set to 4 μm.

After the recessed portion 14 is formed in the mold material 11, the flow path forming member 4 is formed on the substrate 3 and on the mold material 11 (see FIG. 2E). In particular, film made of an inorganic material is formed on the substrate 3 by the CVD method and the inorganic material film covering the mold material 11 is defined as the flow path forming member 4. SiN is used as an inorganic material. A thickness of the film consisting of SiN is 7.0 μm.

Since the SiN film is formed to conform the shape of the mold material 11, the bent portion 8 corresponding to the recessed portion 14 of the mold material 11 is formed in the flow path forming member 4. Since the recessed portion 14 extends in the direction inclined with respect to the X direction, a groove portion formed in a front side of the flow path forming member 4 of the bent portion 8 extends in the direction inclined with respect to the X direction. A groove portion with a width of 9 μm and a depth of 4 μm is formed.

After the flow path forming member 4 is formed, plural ejection ports 6 (see FIGS. 1A and 1B) are formed in the flow path forming member 4. The ejection ports 6 are arranged in the X direction so that the bent portion 8 is disposed between adjoining ejection ports 6. Therefore, the groove portion formed by the bent portion 8 is defined as the intermediate groove portion 10*a* (see FIG. 1A) disposed between adjoining ejection ports 6.

Using the method for manufacturing described above, the flow path forming member 4 having the bent portion 8 may be formed with relatively high precision. The groove formed by the bent portion 8 is defined as the substantially circular-shaped surround grooves 9*a* and 9*b* and the ejection port 6 is disposed inside the surround grooves 9*a* and 9*b*.

Since plural intermediate groove portions 10*a* and 10*b* are formed between adjoining ejection ports 6, stress is distributed to the plural intermediate groove portions 10*a* and 10*b*.

Further, since the center of the surround groove 9*a* is disposed further toward the Y direction that crosses the X direction than the center of the ejection port 6, the direction in which the intermediate groove portion 10*a* of the surround groove 9*a* extends is inclined with respect to the X direction. Therefore, even if the direction in which the intermediate groove portion 10*b* extends is perpendicular to the X direction, a crack produced with the ejection port 6 as a starting point and running in the X direction runs, at the intermediate groove portion 10*a*, along a direction in which the intermediate groove portion 10*a* extends.

Since the intermediate groove portion 10*a* is provided in the liquid ejection head 1, a crack produced at one of the adjoining ejection ports 6 less easily reaches the other of the adjoining ejection ports 6. As a result, damage to the other of the ejection ports 6 caused by the crack produced at one of the plural ejection ports 6 is reduced.

Although the recessed portion 14 is formed in the mold material 11 in the present example, it is not necessary to form the recessed portion 14 in the mold material 11. In that case, a surface of the mold material 11 becomes flat and SiN is formed thereon to a thickness of, for example, 7.0 μm by the CVD method. In this manner, the flow path forming member 4 is formed. Then, asking of SiN which is the flow path forming member 4 is performed using the mask for forming the recessed portion so that a groove may be formed in the flow path forming member. This groove forms a recess on the ejection port surface of the flow path forming member and does not project on the flow path side.

Second Example

Figure 5:
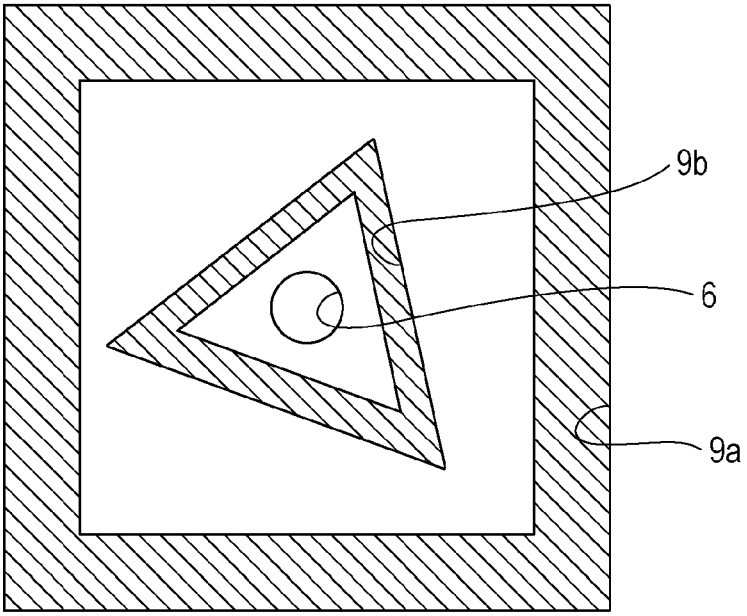
FIG. 5 is an enlarged plan view of a liquid ejection head according to a second example.

FIG. 5 is an enlarged plan view of a liquid ejection head according to a second example of the present invention. Here, description of the same components as those of the first example will be omitted, and components different from those of the first example will be described.

In the first example, the surround grooves 9*a* and 9*b* are similar in shape. In the present example, surround grooves 9*a* and 9*b* are not similar in shape. In particular, the surround groove 9*a* is rectangular and the surround groove 9*b* is triangular in shape.

A certain linear groove portion of the surround groove 9*a* and a linear groove portion of the surround groove 9*b* located between the surround groove 9*a* and an ejection port 6 extends obliquely with respect to that certain linear groove portion of the surround groove 9*a*. Therefore, even if a crack of which running direction crosses perpendicularly to the certain linear groove portion of the surround groove 9*b* runs through the surround groove 9*b*, the crack runs along the surround groove 9*a* when it reaches the surround groove 9*a*. In this manner, development of the crack produced at the ejection port 6 is reduced and damage to the other of the adjoining ejection ports 6 caused by the crack produced at one of the adjoining ejection ports 6 is reduced.

Although one ejection port 6 is surrounded by the two surround grooves 9*a* and 9*b* in the example illustrated in FIG. 5, one ejection port may be surrounded by three or more surround grooves. In this case, it is not necessary that all the surround grooves are in similar shape to one another. It is only necessary that at least two surround grooves are not similar in shape and a groove portion of one of the two surround grooves extends obliquely with respect to a groove portion of the other of the two surround grooves.

Figure 6:
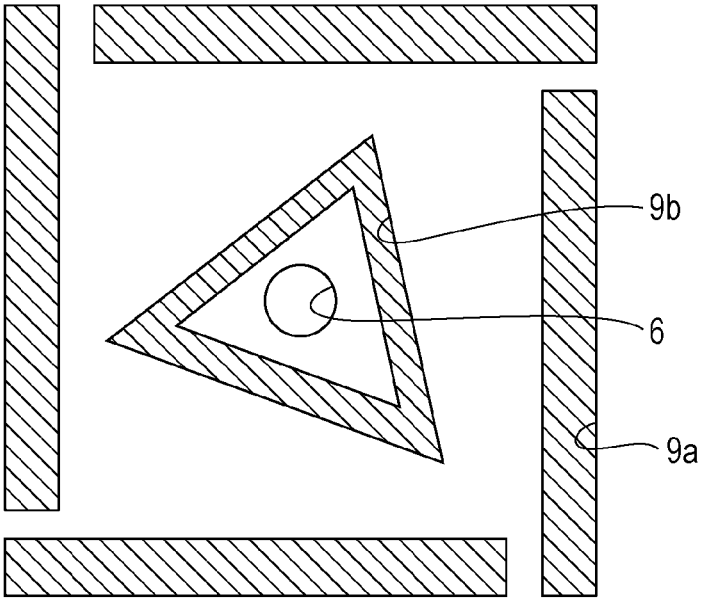
FIG. 6 is an enlarged plan view of a liquid ejection head modified from that of the second example.

Although the surround groove 9*a* illustrated in FIG. 5 is formed as a continuous groove, the surround groove 9*a* may be formed as discontinuous groove portions arranged as illustrated in FIG. 6. FIG. 6 is an enlarged front view of a liquid ejection head according to another embodiment.

Although the centers of the surround grooves 9*a* and 9*b* are located at the center of the ejection port 6 in the examples illustrated in FIGS. 5 and 6, it is not necessary that the centers of the surround grooves 9*a* and 9*b* coincide with the center of the ejection port 6.

Comparative Example

As a comparative example, a liquid ejection head in which no surround groove is formed in the flow path forming member 4 (see FIGS. 1A and 1B) is manufactured. Other configuration is the same as that of the first example.

Durability Test

A durability test in which an impact is applied to the liquid ejection head to cause a crack to be produced is performed. As a result, the average number of ejection ports damaged by one crack is smaller in the liquid ejection head according to the first example and the liquid ejection head according to the second example than in the liquid ejection head according to the comparative example.

Then, the liquid ejection head according to the first example and the liquid ejection head according to the second example are mounted on a recording apparatus and recording is performed. A decrease in defective ejection and a decrease in impairment of recording performance are recognized as compared with the case of the liquid ejection head according to the comparative example.

According to the present invention, damage to the other of the adjoining ejection ports caused by the crack produced at one of the adjoining ejection ports can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-163850 filed Aug. 7, 2013, which is hereby incorporated by reference herein in its entirety.

What is claimed is:

1. A liquid ejection head comprising:

a substrate on which energy generating elements that generate energy with which a liquid is ejected are provided; and a flow path forming member disposed on the substrate, the flow path forming member having a flow path that encloses the energy generating elements and a plurality of ejection ports that are in communication with the flow path formed therein, wherein a groove portion that intersects an imaginary straight line connecting centers of adjoining ejection ports obliquely is formed between the adjoining ejection ports at the flow path forming member, and wherein if the groove portion extends in a curved manner, a tangent of the groove portion on the imaginary line connecting adjoining ejection ports inclines with respect to the X direction and in a case where the groove portion is bent, at a bent position of the groove portion located on the imaginary line connecting adjoining ejection ports, the groove portion of the intermediate groove portion extending linearly from the bent portion is inclined with respect to the X direction.

2. The liquid ejection head according to claim 1, wherein a portion of the flow path forming member at which the groove portion is formed is bent to project on the flow path side.

3. The liquid ejection head according to claim 1, wherein a surround groove that surrounds at least one of the adjoining ejection ports is formed in the flow path forming member; and the groove portion is a part of the surround groove.

4. The liquid ejection head according to claim 3, wherein a plurality of the surround grooves are formed in the flow path forming member and the plurality of the surround grooves surround multiple times at least one of adjoining ejection ports.

5. The liquid ejection head according to claim 4, wherein the plurality of the surround grooves are similar in shape and are not similar in position.

6. The liquid ejection head according to claim 4, wherein: each of the surround grooves is circular or elliptical in shape;

centers of some of the surround grooves among the plurality of the surround grooves are located further toward a second direction that crosses a first direction in which the adjoining ejection ports are arranged than a center of one of the adjoining ejection ports; and centers of other surround grooves among the plurality of the surround grooves are located further toward a third direction that crosses the second direction than the center of one of the adjoining ejection ports.

7. The liquid ejection head according to claim 4, wherein: each of the surround grooves is polygonal in shape; and a first linear groove portion included in some of the surround grooves of the plurality of the surround grooves extends obliquely with respect to a second linear groove portion included in other surround grooves and located next to the first linear groove portion.

8. The liquid ejection head according to claim 4, wherein the plurality of the surround grooves are not similar in shape.

9. The liquid ejection head according to claim 1, wherein the flow path forming member is made of an inorganic material.

10. A liquid ejecting apparatus, comprising:

a liquid ejection head including, a substrate on which energy generating elements that generate energy with which a liquid is ejected are provided, and a flow path forming member disposed on the substrate, the flow path forming member having a flow path that encloses the energy generating elements and a plurality of ejection ports that are in communication with the flow path formed therein, wherein a groove portion that intersects an imaginary straight line connecting centers of adjoining ejection ports obliquely is formed between the adjoining ejection ports at the flow path forming member, and wherein the other of adjoining ejection ports ejects a liquid instead of one of adjoining ejection ports, and wherein if the groove portion extends in a curved manner, a tangent of the groove portion on the imaginary line connecting adjoining ejection ports inclines with respect to the X direction and in a case where the groove portion is bent, at a bent position of the groove portion located on the imaginary line connecting adjoining ejection ports, the groove portion of the intermediate groove portion extending linearly from the bent portion is inclined with respect to the X direction.

* * * * *